United States Patent [19]

Glassco et al.

[11] Patent Number: 4,707,870

[45] Date of Patent: Nov. 24, 1987

[54] TOILET SEAT OR COVER RETAINING DEVICE

[76] Inventors: Margaret M. Glassco, Apt. 12, Bldg. #3, 65 Swindon Way, Winnipeg, Manitoba, Canada, R3P 0T8; John M. Glassco, P.O. Box 651, Soap Lake, Wash. 98851

[21] Appl. No.: 839,142

[22] Filed: Mar. 13, 1986

[51] Int. Cl.[4] ..... A47K 13/24

[52] U.S. Cl. ..... 4/661; 4/237

[58] Field of Search ..... 4/251, 661, 253, 234, 4/235, 239, 248, 237; 292/DIG. 38, 76, 77; 16/85

[56] References Cited

U.S. PATENT DOCUMENTS

| | | | |
|---|---|---|---|
| 1,599,475 | 9/1926 | Kozminski | 4/248 |
| 1,605,631 | 11/1926 | Williams | 4/239 |
| 1,736,602 | 11/1929 | Kenerson | 292/76 |
| 2,334,478 | 11/1943 | Corson | 292/76 |
| 2,918,318 | 12/1959 | Sacharski | 16/85 X |
| 3,997,204 | 12/1976 | Krempp | 292/288 |

FOREIGN PATENT DOCUMENTS

| | | | |
|---|---|---|---|
| 11060 | of 1901 | United Kingdom | 4/235 |

*Primary Examiner*—Charles E. Phillips

*Attorney, Agent, or Firm*—Stanley G. Ade; Adrian D. Battison; Murray E. Thrift

[57] ABSTRACT

A device for detachably securing the cover or a seat of a toilet against the front side of the tank includes a holder detachably securable to the tank and having a stem extending forwardly with a cover or seat engaging component on the distal end thereof. This component may be automatically engageable and disengageable with the cover or seat actuated by movement of the cover or seat, or alternatively, may be manually engageable or disengageable with the cover or seat.

3 Claims, 11 Drawing Figures

TOILET SEAT OR COVER RETAINING DEVICE

BACKGROUND OF THE INVENTION

This invention relates to new and useful improvements in devices for detachably securing either the cover or the seat and cover elements of a toilet in the raised or substantially vertical position.

Conventionally, a toilet seat is pivotally hinged to the toilet bowl adjacent the rear thereof so that the seat can be situated in the substantially horizontal position upon the open upper side of the bowl, or alternatively, can be raised and moved over center to rest against the front of the toilet tank or some such similar support.

Also, a cover or lid is pivotally secured, normally to the same hinging mechanism, in order to cover the open seat or, alternatively, be raised either separately or with the seat to rest against the front of the tank or other support means depending upon design.

Normally, both the lid and seat are held in place by gravity inasmuch as when raised, the lid and/or seat are moved to the vertical position and then slightly over center so that the center of gravity of the seat and/or lid is positioned to hold the seat and/or lid in the raised position against the support whether it be the front of the tank or other support means.

When in the upper position, both the seat and cover are relatively secure given proper design of these elements and the support. However, if a seat or lid is replaced with one of different dimensions or if a decorative, sometimes padded, cover is added to the lid or even if the alignment of the support means such as the tank, relative to the bowl is altered, then a condition often occurs where the said seat and/or lid may not remain in the raised position as desired but tend to fall by gravity to the lowered, substantially horizontal position, sometimes unexpectedly.

The present invention overcomes these disadvantages by providing a selectively operable latching device which can be used to retain either the cover or the seat and cover in the raised position against the tank or other supporting means.

The device may either be actuated automatically by the raising and lowering of the lid or seat and lid combination or, alternatively, can be in the form of a turnbuckle once against manually operated, which may be engaged or disengaged with the lip of the cover or seat, said device being secured to the front of the tank or other supporting means.

SUMMARY OF THE INVENTION

One aspect of the invention is to provide, in a toilet assembly which includes a toilet assembly which includes a toilet bowl, a water tank associated therewith, a toilet seat hinged at the rear side to the bowl and a cover selectively overlying the seat and also hinged to the bowl via the seat hinge; said seat and cover combination movable either separately or together from the substantially horizontal position upon said bowl to a substantially vertical position against the front of said tank and vice versa; the improvement comprising means to detachably retain the seat and cover or cover per se, in the substantially vertical position against the front of the tank, said means including a holder, means to retain said holder on said tank, means extending from said holder, outwardly of said tank and means on said last mentioned means, selectively engageable and disengageable with the cover or seat to detachably secure same in the substantially vertical position against the front of said tank.

Another advantage of the invention is to provide a device which is easily attached to the upper lip or front surface of a toilet tank and can be positioned to engage either the cover or the seat, readily and easily.

A further advantage of the invention is to provide a device which can be actuated automatically by the raising and lowering of the cover or seat or both or, alternatively, can be manually operated.

A still further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicants and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
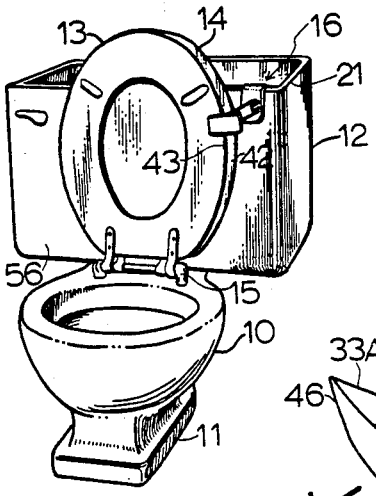
FIG. 1 is an isometric view of a toilet and tank combination with one embodiment of the device secured thereto.

Proceeding therefore to describe the invention in detail, reference character 10 shows a conventional toilet bowl support upon a pedestal 11 in the usual way.

12 illustrates a conventional toilet tank close coupled to the bowl in a conventional manner and reference character 13 shows a conventional centrally apertured seat assembly together with a cover 14 both supported upon a horizontal hinge assembly 15 adjacent the rear side of the bowl as is conventional, so that the seat and lid can be situated in the substantially vertical position illustrated in FIG. 1 or, alternatively, can be lowered either simultaneously or separately to lie horizontally upon the upper open end of the bowl 10.

The invention collectively designated 16 is shown in position upon the tank 12 and adapted to hold both the cover and seat in the substantially vertical position illustrated.

In detail, reference should first be made to FIGS. 2 through 7 which show one embodiment of the device.

It consists of a holder 17 which preferably takes the form of a resilient clip formed of plastic or metal and having a front rectangular face 18 and a rear rectangular face 19 held in spaced apart relationship by means of a junction plate 20 spanning the upper edges of the plates 18 and 19. Such clips are conventional and are resilient so that the plates may spread apart to engage over a member such as the upper edge 21 of the toilet tank 12 a pair of spaced and parallel ears 22 extend from the front plates 17 and support a stem collectively designated 23 extending therefrom and pivoted to the ears by one end thereof, by means of a pivot pin 24.

Figure 3:
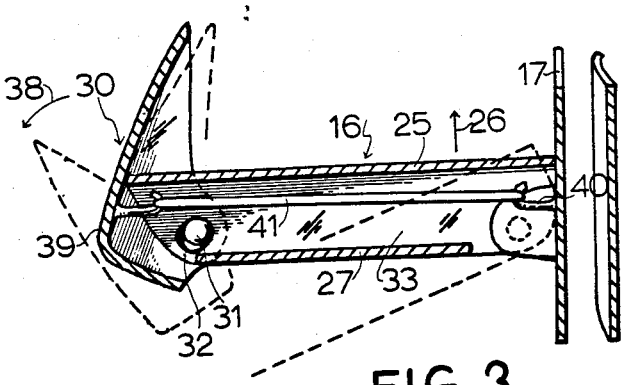
FIG. 3 is a cross sectional view substantially along the line 3—3 of FIG. 2.

The stem 23 is preferably of rectangular cross section and details are shown in FIG. 3.

It will be noted that one side wall 25 engages the surface of the front panel 17 of the holder when the stem is situated substantially perpendicular to the plane of the plate 17 thus restricting movement in the direction of arrow 26. However the other side or 27 is cut away as at 28 and the corners of the upper and lower walls 29 at this location are rounded so that the stem can be moved in a direction opposite to arrow 26 as will hereinafter be described.

A cover or seat engaging member collectively designated 30 is provided and is pivoted adjacent the distal end of the stem by means of pivot pin 31 engaged through elongated slots 32 in the upper and lower spaced apart walls 33 of the element 30.

Figure 2:
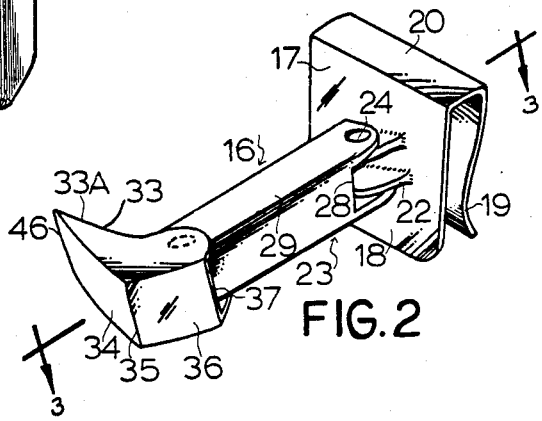
FIG. 2 is an isometric view of one embodiment of the device, enlarged with respect to FIG. 1.

A front wall 34 spans the front edges of the side walls 33 and forms a camming surface which, in the position shown in FIGS. 2 and 3, slopes inwardly from an apex 35 and in the direction of arrow 26. A further front wall portion 36 spans the remaining front edges of the side panels 33 with the vertical edge 37 limiting the pivotal movement of the member 30 when moved in the direction of arrow 38 as will hereinafter be described.

A hook element 39 extends inwardly from the camming surface 34 within the stem 16 and a further hook element 40 extends from the plate 17 between the lugs or ears 22 and also into the stem 17 as clearly shown in FIG. 3 and a resilient member such as a heavy elastic bank 41 engages around both of the hook elements 39 and 40 and is under tension so that the member 30 is held in the position shown in FIG. 3 and the stem 16 is held perpendicular to the plane of the plate 17 as clearly shown in FIG. 3.

The device is engaged over the upper lip 21 of the tank by means of the holder 17 and positioned so that the front camming surface 34 is in the path of the edges 42 of the cover 14 and 43 of the seat 13.

Figure 4:
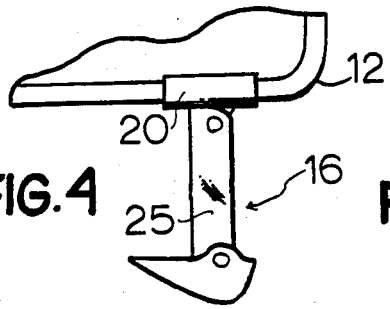
FIG. 4 is a top plan view of the device shown engaged upon the upper lip of a toilet tank, reduced in scale with respect to FIGS. 2 and 3.

In operation, reference should be made to FIG. 4 which shows the device in its normal position biased into this position by means of the resilient member 41 for which of course may be substituted a tension spring if desired.

Figure 5:
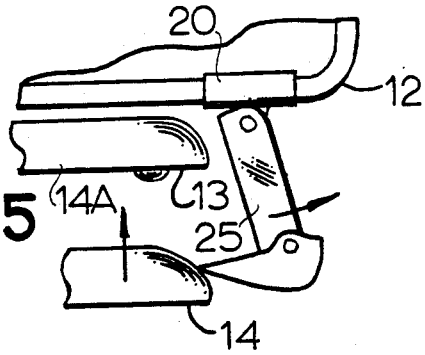
FIG. 5 is a view similar to FIG. 4 but showing same as the toilet seat is being moved therepast.

In FIG. 5, the cover 13 has been moved to the rearmost position and the seat 14 is moving in the direction of arrow 44 with the edge 43 having engaged the camming surface 34 of the member 30.

Figure 6:
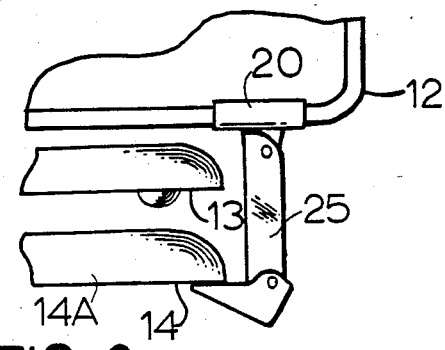
FIG. 6 is a view similar to FIG. 5 but showing the seat and lid retained by the device.
Figure 7:
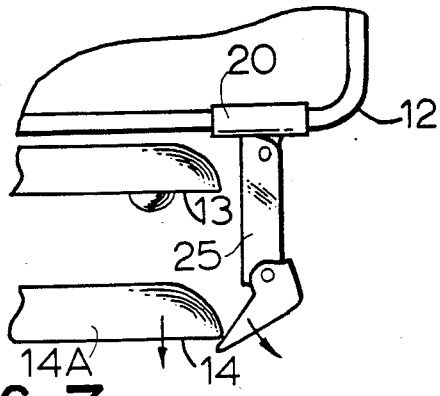
FIG. 7 is a view similar to FIG. 5 but showing the seat displacing the device as the seat is moved towards the horizontal position.

This displaces the stem 23 outwardly in the direction of arrow 45 as clearly shown until the seat edge 43 passes the distal end 46 of the camming surface 34 whereupon the resilient member 41 returns the device to the perpendicular position as shown in FIG. 6 with the rear edges 33A of the upper and lower plates 33 engaging the under surface 14A of the seat 14 thus retaining both the seat and the cover in the substantially vertical position shown in FIG. 1.

It will of course be appreciated that only the cover 13 may be raised if desired but will also be retained in a similar manner, in the substantially vertical position.

When it is desired to lower the seat 14, it is moved in the direction of arrow 46 thus displacing the member 30 by moving same in the direction of arrow 38 against resilient member 41 which returns the element 30 to the position shown in FIG. 4, after the seat has passed thereby. Similarly the cover can be moved to the closed or horizontal position either separately or at the same time as seat 14.

Figure 8:
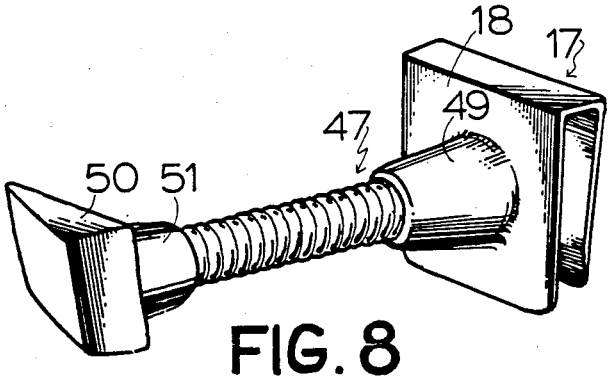
FIG. 8 is an isometric view of one of the preferred embodiments of the device.
Figure 9:
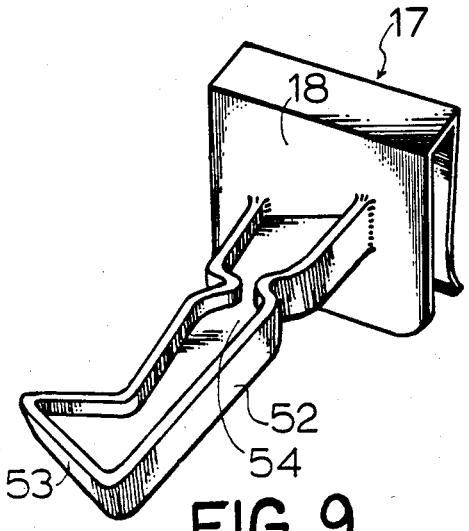
FIG. 9 is an isometric view of another of the preferred embodiments.

The preferred embodiment is shown in FIGS. 8 and 9 in which the stem 47 is in the form of a tightly wound spring 48, in FIG. 8, secured by the inner end thereof to a boss 49 extending from the front plate 18 of the holder 17.

The member 50, similar in configuration to member 30, instead of being pivoted to the distal end of the stem 47, is provided with a boss 51 similar to boss 49 engaged over the distal end of the spring 48. It functions in a manner similar to that hereinbefore described with the exception that the entire member 50 and spring or stem 47 is deflected one way or the other as the edge of the cover and/or the seat passes thereby in either direction, the spring 48 being sufficiently strong to maintain either the seat or the seat and cover in the substantially vertical position similar to that shown in FIG. 6.

In FIG. 9, the stem 52 is formed from plastic integrally with the element 53 which is similar to element 50 and a living hinge 54 is provided along the length of stem 52 which again is formed integrally with the front panel 18 of the clip 17. This living hinge provides deflection in a horizontal plane and operates in a manner similar to that shown and described for FIG. 8 with both the spring 48 in FIG. 8 and the living hinge 54 in FIG. 9 normally maintaining the stem perpendicular to the plane of the plate 18.

Figure 10:
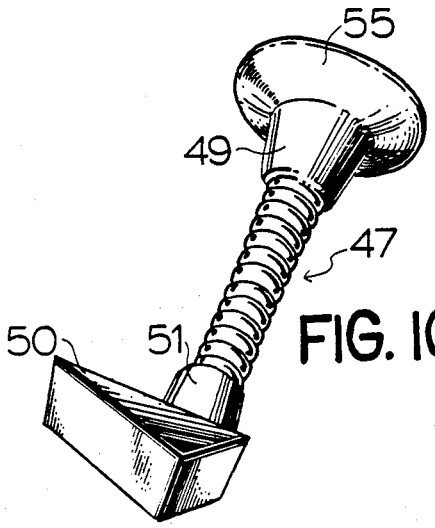
FIG. 10 is a view similar to FIG. 8 but showing an alternative method of supporting the device upon the front of the tank surface.

FIG. 10 is similar to FIG. 8 but showing an alternative method of attachment taking the form of a suction cup 55 by which the device can be positioned upon the surface of the front wall 56 of the tank 12, it being understood that the suction cup is interchangeable with the clip 17 in all embodiments.

Figure 11:
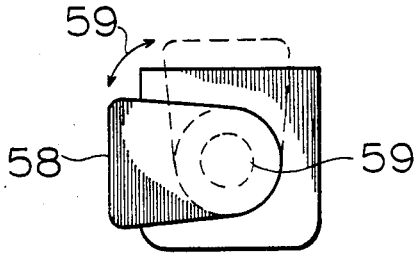
FIG. 11 is a front elevation of an alternative embodiment of the device.

Finally, FIG. 11 shows a relatively simple adaptation of the device in which the distal end 57 of the stem is screw threaded to receive the element 58 which is similar to element 50 in FIG. 8 but which is screw threadably engaged upon this screw threaded distal end 57 of the stem and can be moved from the position shown in solid line in FIG. 11, to the position in phantom and vice versa, travelling in a direction of an arc indicated by double-headed arrow 59, it being understood that the element 58 in FIG. 11 is manually rotated from one position to the other in order to engage or disengage the edges of the cover and/or seat 13 and 14 respectively.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. In combination with a toilet assembly which includes a toilet bowl, a water tank associated therewith and having an upper front edge, a toilet seat hinged at the rear side to the bowl and a cover selectively overlying the seat and also hinged to the bowl via the seat hinge, said seat and cover combination adapted to be moved either separately or together from a substantially horizontal position upon said bowl to a substantially vertical position against the front of said tank and vice-versa; a device for selectively and detachably retaining the seat and cover or cover per se, in the substantially vertical position against the front of the associated tank, said device comprising a resilient clip formed from synthetic plastic and having a front wall, a rear wall and a junction plate extending between the upper ends of said walls, the resiliency of the material forming said clip urging the lower end of said rear wall towards said front wall whereby said clip is adapted to grip the upper front edge of the water tank, when installed thereon, to resist sideways movement of said device along the upper front edge of the tank during use, a synthetic plastic stem extending perpendicularly from the plane of the front wall of said clip, a vertically situated living hinge formed along the length of said stem whereby the portion of said stem outboard of said hinge is adapted to deflect sideways in a substantially horizontal plane and to return to the original position when supported upon said water tank by said resilient clip, an engaging member formed on the distal end of said stem for detachably and selectively retaining the seat and cover or cover per se in the said vertical position, said member being in the form of a hook formed integrally with the stem and including a front camming surface and a rear, seat and cover or cover per se engaging surface, movement of said seat and cover or cover per se, towards the vertical position against the water tank, adapted to deflect said stem sideways as the seat and cover or cover per se engages said camming surface, said living hinge returning the outboard portion of said stem and said member towards the original position relative to said clip and engaging the edge of said seat or seat cover.

2. The combination according to claim 1 in which said stem includes a pair of spaced and parallel vertically situated flanges and a web extending therebetween thus having an H-shaped cross sectional configuration, said hook component forming an extension of said stem and having a similar cross sectional configuration.

3. The combination according to claim 1 in which said camming surface includes outwardly and rearwardly from the distal end of said stem, said engaging surface extending inwardly and rearwardly from the outer end of said camming surface, to one side edge of said stem adjacent the distal end thereof.

* * * * *